US012000271B2

(12) United States Patent
Fiddo et al.

(10) Patent No.: US 12,000,271 B2
(45) Date of Patent: Jun. 4, 2024

(54) AUTONOMOUS WELLBORE DRIFT ROBOT

(71) Applicant: SAUDI ARABIAN OIL COMPANY, Dhahran (SA)

(72) Inventors: Fiddoson Sweiyi Fiddo, Al Khobar (SA); Torty Chinenye Kalu-Ulu, Ras Tanurah (SA); Meshal A. Al-Amri, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/823,864

(22) Filed: Aug. 31, 2022

(65) Prior Publication Data

US 2024/0068362 A1 Feb. 29, 2024

(51) Int. Cl.

| | |
|---|---|
| ***E21B 47/13*** | (2012.01) |
| ***E21B 23/00*** | (2006.01) |
| ***E21B 47/002*** | (2012.01) |
| ***E21B 47/024*** | (2006.01) |
| ***E21B 47/08*** | (2012.01) |

(52) U.S. Cl.

CPC ..... *E21B 47/13* (2020.05); *E21B 47/0025* (2020.05); *E21B 47/024* (2013.01); *E21B 47/08* (2013.01); *E21B 23/001* (2020.05)

(58) Field of Classification Search

CPC ..... E21B 47/024; E21B 47/08; E21B 23/001

See application file for complete search history.

(56) References Cited

U.S. PATENT DOCUMENTS

| | | | | |
|---|---|---|---|---|
| 5,172,639 | A * | 12/1992 | Wiesman | F16L 55/28 104/138.2 |
| 5,284,096 | A * | 2/1994 | Pelrine | F16L 55/26 301/5.23 |
| 6,450,104 | B1 * | 9/2002 | Grant | B08B 9/049 104/138.1 |
| 2018/0112486 | A1 * | 4/2018 | Potts | E21B 43/11 |
| 2020/0248517 | A1 * | 8/2020 | Bouldin | E21B 17/028 |

FOREIGN PATENT DOCUMENTS

| | | | |
|---|---|---|---|
| EP | 3784563 | A1 | 3/2021 |
| WO | 2019/209826 | A1 | 10/2019 |

OTHER PUBLICATIONS

Moustanir, Mohamed et al., "Four-Propellers Underwater Drone Modelling", E3S Web of Conferences, vol. 299, 2021 (6 pages).

* cited by examiner

*Primary Examiner* — Robert E Fuller

(74) *Attorney, Agent, or Firm* — Osha Bergman Watanabe & Burton LLP

(57) ABSTRACT

A drift robot performs a drifting operation of a wellbore in a subterranean formation. The drift robot includes an elongated body to be deployed into a well conduit in the wellbore, a propulsion system for propelling the elongated body to traverse the well conduit, retractable landings attached to the elongated body for selectively anchoring the elongated body to an internal surface of the well conduit, sensors attached to the elongated body to generate sensor measurements of the well conduit, a smart camera disposed at one end of the elongated body to capture camera images of interior features of the well conduit, and a controller that adjusts the elongated body based at least on the sensor measurements and the camera images.

14 Claims, 4 Drawing Sheets

AUTONOMOUS WELLBORE DRIFT ROBOT

BACKGROUND

Drifting is an operation to verify the inside diameter of a pipe or other cylindrical passage by pulling a cylinder or pipe (referred to as a drift or a rabbit) of known outside diameter through the pipe or cylindrical passage. The diameter of the drift (i.e., drift diameter) used in drifting is the inside diameter (ID) that the pipe manufacturer guarantees per specifications. During well development, the drift diameter is used by the well planner to determine what size tools or tubulars can later be run through the wellbore completion, whereas the verified nominal ID is used for fluid volume calculations such as mud circulating times and cement slurry placement calculations. Drifting is also performed to ensure that there is no junk, dried cement, dirt, rocks or other debris inside the wellbore completion.

Drifting through wellbore completions has been performed through wireline and/or slickline operations. Dummy drifts of cylindrical solid metal are deployed through the well tubular using wires connected to a surface drum. This conventional approach requires wireline/slickline trucks or offshore wireline/slickline units and cable drums to deploy the drift. A number of operators and multiple days are required to rig up and rig down slickline tools, and to prepare and mobilize slickline truck or units to and from rig sites. The success or failure of the drifting operation depends on carefully and manually monitoring the pressure exerted on the wire and other critical parameters.

SUMMARY

In general, in one aspect, the invention relates to a drift robot for performing a drifting operation of a wellbore in a subterranean formation. The drift robot includes an elongated body to be deployed into a well conduit in the wellbore, a propulsion system for propelling the elongated body to traverse the well conduit, a plurality of retractable landings attached to the elongated body for selectively anchoring the elongated body to an internal surface of the well conduit, a plurality of sensors attached to the elongated body to generate sensor measurements of the well conduit, a smart camera disposed at one end of the elongated body to capture camera images of interior features of the well conduit, and a controller configured to navigate the elongated body based at least on the sensor measurements and the camera images.

In general, in one aspect, the invention relates to a system for performing a drifting operation of a wellbore in a subterranean formation. The system includes a remote-control console at the Earth surface that is used by a user to monitor the drifting operation, and a drift robot that includes an elongated body to be deployed into a well conduit in the wellbore, a propulsion system for propelling the elongated body to traverse the well conduit, a plurality of retractable landings attached to the elongated body for selectively anchoring the elongated body to an internal surface of the well conduit, a plurality of sensors attached to the elongated body to generate sensor measurements of the well conduit, a smart camera disposed at one end of the elongated body to capture camera images of interior features of the well conduit, a controller configured to navigate the elongated body based at least on the sensor measurements and the camera images, and a wireless communication interface configured to receive a user command from the remote-control console to the controller, and selectively send the sensor measurements and the camera images from the controller to the remote-control console.

In general, in one aspect, the invention relates to a method for performing a drifting operation of a wellbore in a subterranean formation. The method includes disposing, from a wellhead of the wellbore, a drift robot into a well conduit in the wellbore, where the drift robot includes an elongated body, a propulsion system for propelling the elongated body to traverse the well conduit, a plurality of retractable landings attached to the elongated body for selectively anchoring the elongated body to an internal surface of the well conduit, a plurality of sensors attached to the elongated body to generate sensor measurements of the well conduit, a smart camera disposed at one end of the elongated body to capture camera images of interior features of the well conduit, a controller configured to navigate the elongated body based at least on the sensor measurements and the camera images, and a wireless communication interface to provide wireless data communications, selectively sending, using the wireless communication interface, the sensor measurements and the camera images to a remote-control console at the Earth surface, and selectively displaying, using the remote-control console, the sensor measurements and the camera images for viewing by a user.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments disclosed herein provide a system, an autonomous robot device, and a method to perform wellbore surveillance and monitoring. The results of wellbore surveillance and monitoring may be used to facilitate a well development and/or intervention operation. In one or more embodiments, drifting of wellbore completions is performed remotely using a remote-controlled drift robot. Controlled through a remote-control console of an operator, the drift robot is deployed and retrieved from the wellhead or a tubular open end. The drift robot includes a propulsion system to propel itself to a target depth in the completion conduit. In an example implementation, the drift robot includes propellers mounted at both ends and powered through an internal rechargeable battery.

In one or more embodiments, the drift robot is equipped with adjustable mechanisms (e.g., retractable landings) and smart sensors that are preset based on the size of a tool to be utilized for the well development/intervention operation. The retractable landings anchor the drift robot at a target depth where the drift robot is expected to stay stationary. The drift robot also includes a smart camera that captures real time images of wellbore components and conditions. The smart cameras are coupled to an artificial intelligence (AI) enabled controller to detect curvatures in the completion profile for initiating body adjustments of the drift robot. In particular, the smart camera and the AI enabled controller collectively enables the drift robot to traverse through curves or sharply inclined well completion profiles.

Figure 1:
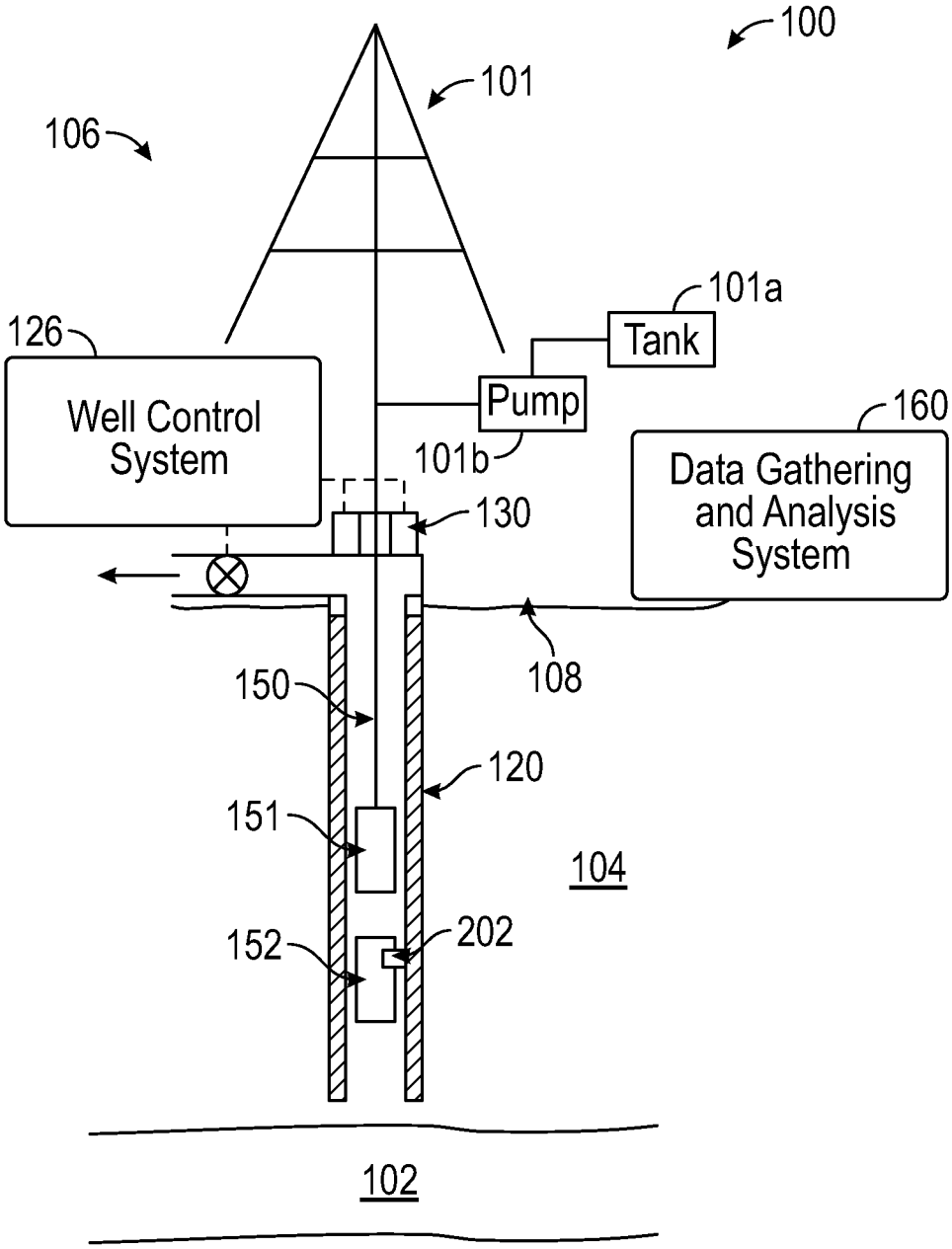
FIG. 1 shows a well system in accordance with one or more embodiments.

FIG. 1 shows a schematic diagram of a well environment in accordance with one or more embodiments. In one or more embodiments, one or more of the modules and/or elements shown in FIG. 1 may be omitted, repeated, and/or substituted. Accordingly, embodiments disclosed herein should not be considered limited to the specific arrangements of modules and/or elements shown in FIG. 1.

As shown in FIG. 1, a well environment (100) includes a subterranean formation ("formation") (104) and a well system (106). The formation (104) may include a porous or fractured rock formation that resides underground, beneath the Earth surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120), a data gathering and analysis system (160), and a well control system (126). The well control system (126) may control various operations of the well system (106), such as well production operations, well drilling operation, well completion operations, well maintenance operations, well development and/or intervention operations, and reservoir monitoring, assessment and development operations. In some embodiments, the well control system (126) includes a computer system.

The rig (101) is the machine used to drill a borehole to form the wellbore (120). Major components of the rig (101) include the drilling fluid tanks (e.g., tank (101*a*)), the drilling fluid pumps (e.g., pump (101*b*)), the derrick or mast, the draw works, the rotary table or top drive, the drill string, the power generation equipment, and auxiliary equipment. Drilling fluid, also referred to as "drilling mud" or simply "mud," is used to facilitate drilling the wellbore (120) into the Earth, such as drilling oil and natural gas wells. The wellbore (120) includes a bored hole (i.e., borehole) that extends from the surface (108) towards a target zone of the formation (104), such as the reservoir (102). The wellbore (120) may be drilled for exploration, development and production purposes. The wellbore (120) may facilitate the circulation of drilling fluids during drilling operations for the wellbore (120) to extend towards the target zone of the formation (104), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of logging tools lowered into the formation (104) or the reservoir (102) during logging operations. The wellbore (120) may be logged by lowering a combination of physical sensors downhole to acquire data that measures various rock and fluid properties, such as irradiation, density, electrical and acoustic properties. The acquired data may be organized in a log format and referred to as well logs or well log data.

In some embodiments, the wellbore (120) may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In embodiments having a casing, the casing defines a central passage that provides a conduit for the transport of tools and substances through the wellbore (120). For example, the central passage may provide a conduit for lowering logging tools into the wellbore (120), a conduit for the flow of production (e.g., oil and gas) from the reservoir (102) to the surface (108), or a conduit for the flow of injection substances (e.g., water) from the surface (108) into the formation (104). In some embodiments, production tubings (referred to as "tubulars") are installed in the wellbore (120). The production tubing may provide a conduit for the transport of tools and substances through the wellbore (120). The production tubing may, for example, be disposed inside the casing. In such an embodiment, the production tubing may provide a conduit for some or all of the production (e.g., oil and gas) passing through the wellbore (120) and the casing. Although the wellbore (120) is shown as following a linear trajectory downward into the formation (104), the wellbore (120) may also follow a non-linear (e.g., curved along the longitudinal direction) trajectory downward and/or sideways in the formation (104). For example, the wellbore (120) may include one or more non-linear (e.g., curved along the longitudinal direction) sections.

In some embodiments, the well system (106) includes a wellhead (130). The wellhead (130) may include a rigid structure installed at the "up-hole" end of the wellbore (120), at or near where the wellbore (120) terminates at the Earth surface (108). The wellhead (130) may include structures (referred to as "wellhead casing hanger" for casing and "tubing hanger" for production tubing) for supporting (or "hanging") casing and production tubing extending into the wellbore (120).

In some embodiments, a drift (151) is attached to a wireline or slickline (150) to suspend into the wellbore (120) for performing the well drifting operation. In one or more embodiments, in place of the drift (151) suspended from the wireline/slickline (150), a drift robot (152) is deployed into the wellbore (120) from the wellhead (130) to perform surveillance and monitoring operations, such as the drifting operation. The drift robot (152) may be deployed to traverse the well conduits, such as the casings of the wellbore (120) or other tubulars (e.g., drill pipe or production tubing) in the wellbore (120). In addition, the drift robot (152) may park at a target depth using one or more retractable landings (202).

In some embodiments, the data gathering and analysis system (160) includes hardware and/or software with functionality for facilitating operations of the well system (106), such as well production operations, well drilling operation, well completion operations, well maintenance operations, well development/intervention operations, and reservoir monitoring, assessment and development operations. For example, the data gathering and analysis system (160) may include a remote-control console of an operator that communicates with the drift robot (152) and other downhole sensors to retrieve and analyze surveillance and monitoring data of the drifting operation. The analysis result may be used to facilitate the operations of the well system (106), such as the well development and/or intervention operations. For example, the data gathering and analysis system (160) may generate control signals, based on the analysis results of the drifting operation, for the well control system (126) to control a subsequent well intervention operation. While the data gathering and analysis system (160) is shown at a well site, embodiments are contemplated where at least a portion of the data gathering and analysis system (160) is located away from well sites. In some embodiments, the data gathering and analysis system (160) may include a computer system that is similar to the computing device (400) described below with regard to FIG. 4 and the accompanying description.

Figure 2:
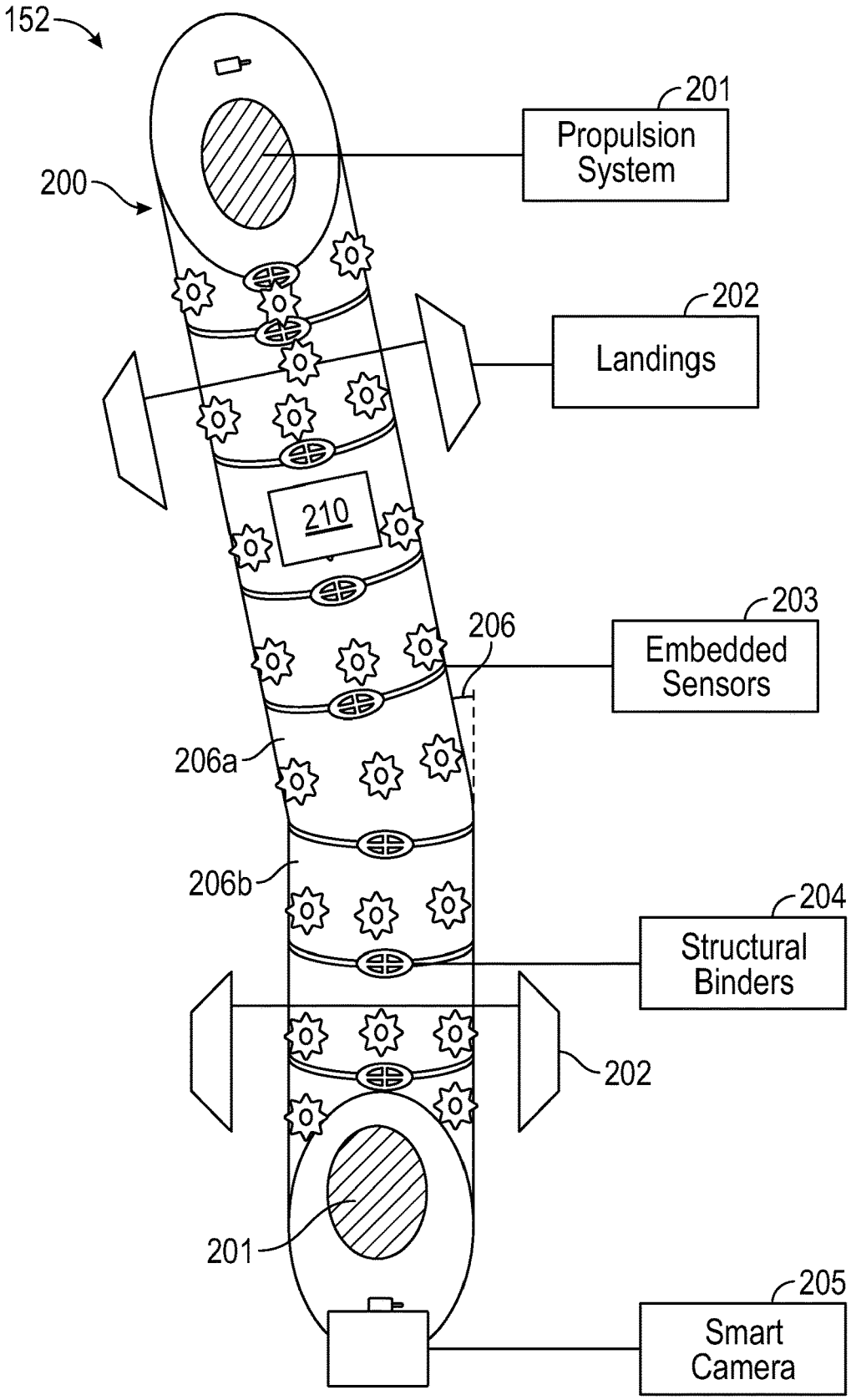
FIG. 2 shows schematic diagrams of a wellbore drift robot in accordance with one or more embodiments.

FIG. 2 shows a schematic diagram in accordance with one or more embodiments. In particular, FIG. 2 illustrates details of the drift robot (152) depicted in FIG. 1 above. In one or more embodiments, one or more of the modules and/or elements shown in FIG. 2 may be omitted, repeated, and/or substituted. Accordingly, embodiments of the invention should not be considered limited to the specific arrangements of modules and/or elements shown in FIG. 2.

As shown in FIG. 2, the drift robot (152) includes a body (200), a propulsion system (201), retractable landings (202), embedded sensors (203), structural binders (204), a smart camera (205), and a controller (210). The body (200) is an enclosure assembly of the drift robot (152) where the other components of the drift robot (152) are attached or enclosed. In one or more example embodiments, the body (200) may have a width ranging from 2.78 to 3.83 inches, a length ranging from 12 to 24 inches, and a height/thickness ranging from 3 to 5 mm. However, the body may have different dimensions without departing from the scope disclosed herein. In one or more embodiments, the body (200) is an air-tight cylinder that holds landing legs of the retractable landings (202) and propellers of the propulsion system (201). As shown in FIG. 2, the cylinder shape of the body (200) is composed of a sequence of segments (e.g., segment A (206*a*), segment B (206*b*)) linked via the structural binders (204). The sequence of segments allow the drift robot (152) to easily maneuver around curved sections of the wellbore (120). Each segment of the body (200) includes a number of embedded sensors (203) and is a modular building block of the drift robot (152). Two or more of the segments are installed with the retractable landings (202) such that the drift robot (152) has a centipede-like segmented shape for easy maneuvering at curved sections of the wellbore. Each segment may be a flat/smooth circular segment of the cylinder.

The propulsion system (201) is installed on both ends of the drift robot (152) to provide required momentum to move in both directions when traversing through the well conduit. The propulsion system (201) may include compact propellers to provide high speed and flexible movement of the drift robot (152). The propellers at both ends of the drift robot (152) provide weight balance against gravity effect and hydrodynamic forces as the drift robot (152) travels through the depth of the well conduit. The propellers also provide means to keep the robot afloat and/or stationary in the well conduit.

The retractable landings (202) are mechanical feet with adjustable length (e.g., via foldable legs) used to latch on to the tubulars and activated when the drift robot (152) arrives at the location for retrieval (e.g., the Earth surface or at the target depth). For example, the mechanical feet may extend to attach to and rest on the tubular internal surface walls to save energy when a prolonged survey is needed at a particular spot in the tubular conduit. In one or more embodiments, a motorized gear system controls the retractable landings (202) to extend and retract. For example, the retractable landings (202) are extended to press against the internal surface of the tubular (i.e., the tubular wall) when the drift robot (152) reaches the target depth, thereby providing anchorage and preventing slippage of the drift robot (152) when needed, for example, when a prolonged survey is needed at a particular spot in the tubular conduit. As shown in FIG. 2, the body (200) is bent such that the retractable landings (202) are able to latch on to a non-linear (e.g., curved along the longitudinal direction) section of the tubulars.

The embedded sensors (203) are preset and spaced based on the size of the body (200). The embedded sensors (203) may include vision/imaging sensors and/or position sensors that generate real-time internal diameter measurements of the well conduit. The diameter measurements are analyzed, e.g., using AI algorithms (e.g., supervised machine learning algorithms such as linear regression, logistic regression, naive Bayes classifier, decision tree, support vector machine, etc.) of the controller (210), to (i) determine if the drift robot (152) can be deployed safely through the well conduit, and (ii) to identify locations in the well conduit where obstacles exist that may impede the drifting operation. For example, the exterior geometric profile of the drift robot (152) may be stored by the controller (210) and compared to the internal diameter measurements of the well conduit to generate such safe deployment determination and/or obstacle identification. The safe deployment determination and/or obstacle identification may be sent to a remote-control console at the Earth surface to alert a surface personnel, referred to as a user of the drift robot (152) or the operator of the drifting operation.

The embedded sensors (203) may also generate measured properties of particles found in the well conduit that are likely to cause obstruction. Examples of the embedded sensors (203) may include vision sensor, imaging sensor, position sensor, etc. The measured particle properties are analyzed to facilitate the drift robot (152) responding to the potential obstruction. For example, the measured particle properties may be analyzed by the controller (210) to generate an alert for sending to a remote-control console at the Earth surface. In response to the alert based on the diameter measurements and/or measured particle properties, the surface personnel may in turn send a command to the drift robot (151) to hover in place pending further instruction, to return to the Earth surface and abort the drifting operation, or to perform body adjustments to adapt to the obstruction.

The structural binders (204) are liquid-tight mechanical linking mechanisms. Each linking mechanism links two adjacent segments of the body (200) and adjusts an angle (e.g., angle (206)) between the two segments (e.g., segment A (206*a*), segment B (206*b*)) to bend the body (200) to conform to any curvature of the borehole where the drift robot (152) travels to. The structural binders (204) enable the drift robot (152) to easily maneuver around curved sections of the wellbore (120). Although only the segment A (206*a*) and the segment B (206*b*) are shown in FIG. 2 to be bent with a non-zero angle (206), multiple pairs of adjacent segments may be bent (i.e., each forming a non-zero angle) such that the body (200) may assume a suitable shape to conform to a particular curved form of the borehole. In one or more embodiments, the number of segments of the body may depend on the length of the body of the drift robot (152).

The smart camera (205) is equipped with a combination of hardware (i.e., circuitry) and software to detect features (e.g., curvatures and surfaces) in the completion conduit and to initiate body adjustments of the drift robot (152) to traverse through curves or sharply inclined well completion profiles. The profile feature detection and body adjustments are performed based on AI algorithms (e.g., supervised machine learning algorithms) stored in computer memory of the smart camera (205). The smart camera (205) also captures real-time images of wellbore components and conditions that are used for surveillance and monitoring during deployment.

The controller (210) includes hardware (i.e., circuitry), software, or any combination thereof to provide interface to a remote surface control application, e.g., installed on the remote-control console used by the surface personnel, such as an operator or user of the drift robot (152). The interface allows the surface personnel to interact with the drift robot (152) by way of wireless data communication (e.g., Wi-Fi). For example, tubular internal surface images captured by the smart camera (205) may be streamed in real-time to the remote-control console to be viewed by the surface personnel. A global positioning system (GPS) device may also be included in the controller (210) or other portion of the drift robot (152) to facilitate navigation while enabling stabilization and safe return of the drift robot (152) to the Earth surface.

The smart camera (205) and the controller (210) may be separate from each other or include combined portions. For example, the computer memory storing the AI algorithms of the smart camera (205) may be embedded in the controller (210). In this scenario, the controller (210) is referred to as an AI enabled controller. In one or more embodiments, portions of the smart camera (205) and the controller (210) may be implemented using the computing device (400) described below in reference to FIG. 4.

Figure 3:
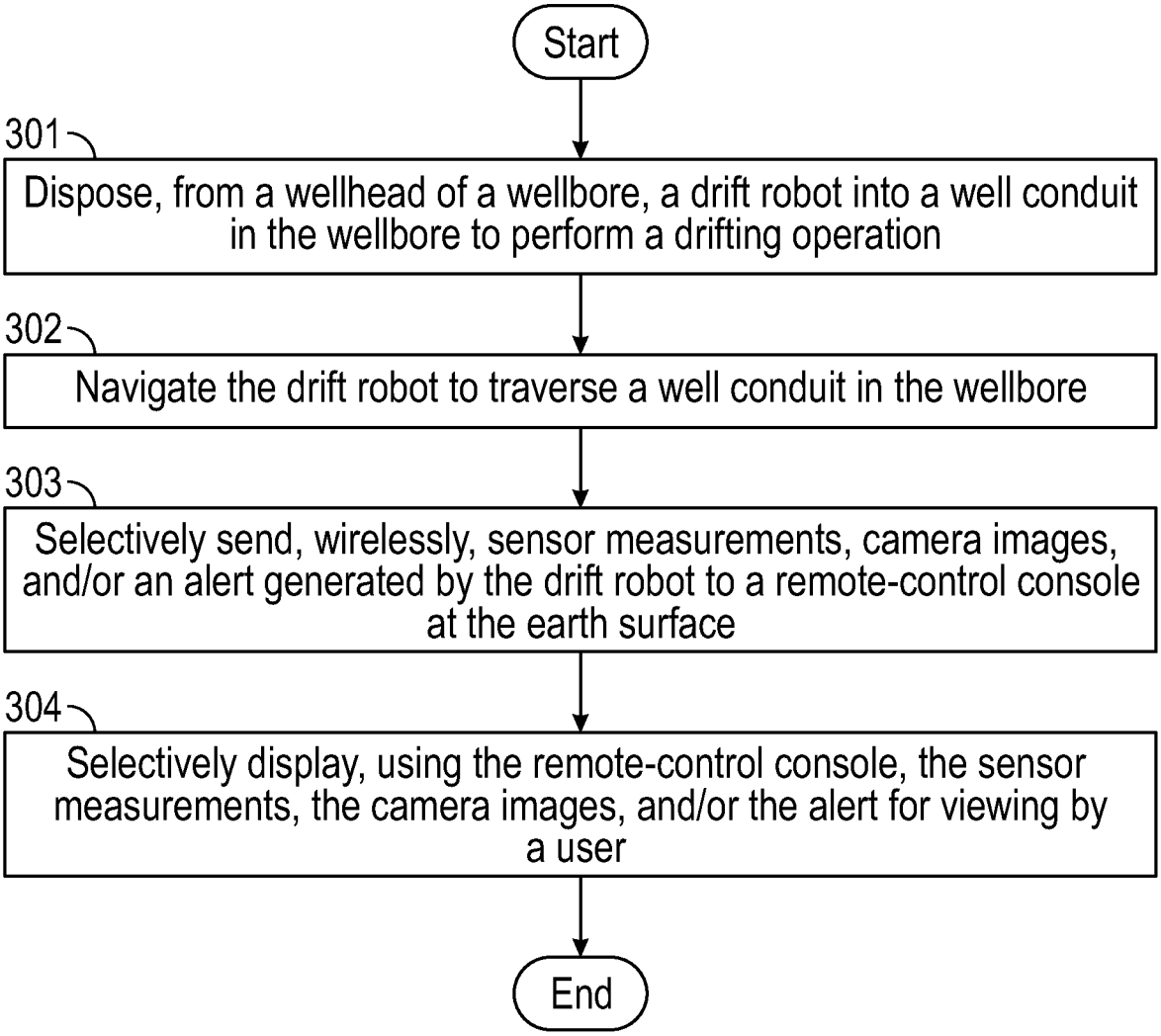
FIG. 3 shows a flowchart in accordance with one or more embodiments.

FIG. 3 shows a flowchart in accordance with one or more embodiments disclosed herein. One or more of the steps in FIG. 3 may be performed by the components of the well environment (100), in particular the drift robot (152) and the data gathering and analysis system (160), discussed above in reference to FIGS. 1 and 2. In one or more embodiments, one or more of the steps shown in FIG. 3 may be omitted, repeated, and/or performed in a different order than the order shown in FIG. 3. Accordingly, the scope of the disclosure should not be considered limited to the specific arrangement of steps shown in FIG. 3.

Referring to FIG. 3, initially in Step 301, a drift robot is disposed into a well conduit in a wellbore to perform a drifting operation. In one or more embodiments, the drift robot is disposed through the wellhead of the well.

In Step 302, the drift robot is navigated to traverse a well conduit. In one or more embodiments, the drift robot is propelled by a built-in propulsion system and adjusted in response to detecting a curved section of the well conduit. The curved section may be detected by analyzing camera images captured using a smart camera mounted on one or both ends of the drift robot. In response to detecting an incoming curved section of the well conduit, the drift robot may be steered to adjust the trajectory or otherwise adjusted to change the body shape to pass through the curved section. In one or embodiments, the body adjustment is performed by adjusting structural binders connecting a sequence of segments that form the body of the drift robot. For example, the body may be bent or twisted similar to a centipede crawling along a curved or inclined path.

In one or more embodiments, the drift robot as propelled by the built-in propulsion system may be parked at a target location in the well conduit by extending built-in retractable landings against an internal wall of the well conduit. For example, the drift robot may include a GPS device to detect itself reaching preset GPS coordinates of the target location.

In one or more embodiments, while traversing the well conduit, the drift robot generates sensor measurements and camera images using built-in sensors and a built-in smart camera device. For example, the sensor measurements may include internal diameter of the well conduit and property measurements of particles found in the well conduit. The camera images may correspond to interior features of the well conduit, such as surface curvatures, debris, distortions, etc.

In Step 303, the sensor measurements and the camera images generated by the drift robot are sent wirelessly and in real-time to a remote-control console at the Earth's surface. For example, the ID of the inner tubular can be measured during drift and transmitted live to Earth's surface. In addition, upon detecting an obstacle or obstruction in the well conduit, the drift robot sends an alert along with the sensor measurements and the camera images to the remote-control console. For example, an artificial intelligence (AI) software installed in the drift robot may be used to analyze the sensor measurements and the camera images to detect the obstacle or obstruction.

In Step 304, the sensor measurements, the camera images, and/or the alert are selectively displayed using the remote-control console for viewing by a user. In response, the user may send a user command to the drift robot via the remote-control console. For example, the user command may instruct the drift robot to hover in place pending further instruction, to return to the Earth's surface and abort the drifting operation, or to perform body adjustments to adapt to the obstruction. The drifting operation may then be completed by the drift robot if no obstacles are encountered.

Embodiments described above provide the following advantages for the drifting operation: (i) reduction in deployment personnel, (ii) reduction in deployment time, (iii) no slickline/wireline needed for deployment, as deployment is wireless, (iv) remote deployment, (v) real-time seamless information, (vi) cost effectiveness, and (vii) improved operational efficiency. Specifically, the wellbore drift robot eliminates the problem of deploying heavy equipment during wireline or slickline operations, eliminates the potential of losing wires in the wellbore, eliminates the requirement of several runs using dummy drift, and provides means of internal tubular surface surveillance and monitoring.

Figure 4:
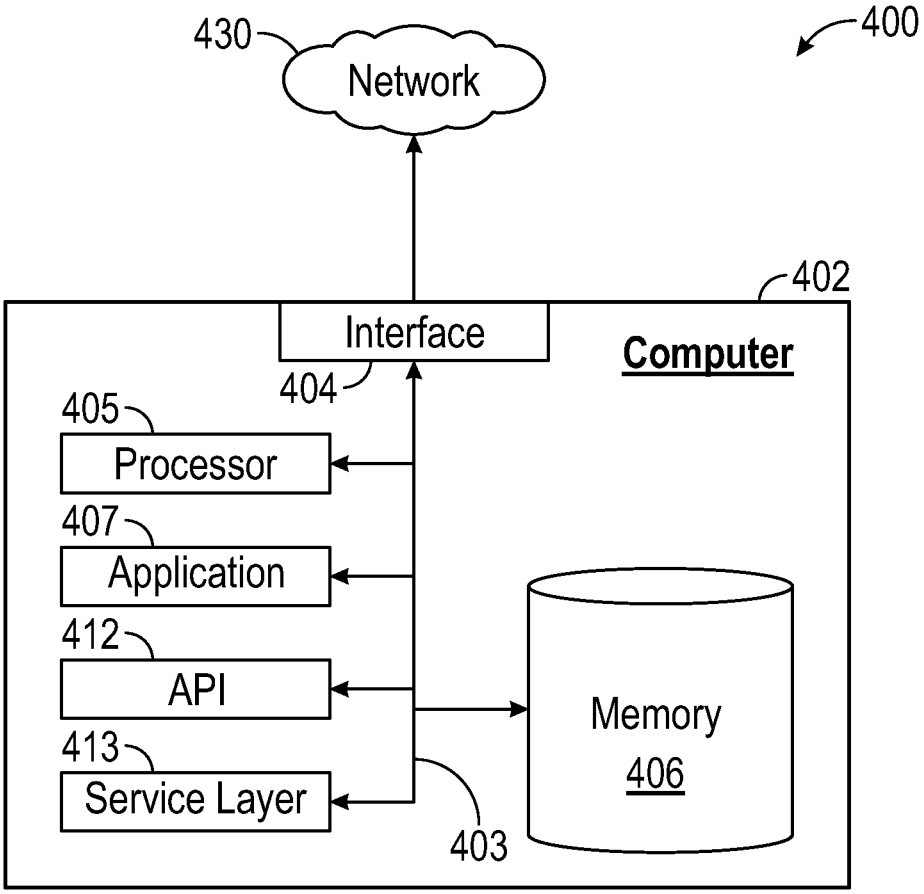
FIG. 4 shows a computing device in accordance with one or more embodiments.

Embodiments may be implemented using a computing device. For example, the controller (210) and data gathering and analysis system (160) may be implemented on a computer device. FIG. 4 depicts a block diagram of a computing device (400) including a computer (402) used to provide computational functionalities associated with described machine learning networks, algorithms, methods, functions, processes, flows, and procedures as described in this disclosure, according to one or more embodiments. The illustrated computer (402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or another suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols, such as the Wellsite Information Transfer Specification (WITS) protocol, associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing a computer (402), wherein each computer (402) communicates over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

While the invention has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed:

1. A drift robot for performing a drifting operation of a wellbore in a subterranean formation, comprising:

an elongated body to be deployed into a well conduit in the wellbore and comprising:

a plurality of segments connected into a sequence; and a linking mechanism that links two adjacent segments and adjusts an angle between the two adjacent segments;

a propulsion system for propelling the elongated body to traverse the well conduit;

a plurality of retractable landings attached to the elongated body for selectively anchoring the elongated body to an internal surface of the well conduit;

a plurality of sensors attached to the elongated body to generate sensor measurements of the well conduit;

a smart camera disposed at one end of the elongated body to capture camera images of interior features of the well conduit; and a controller that analyzes the camera images to detect a curved section of the well conduit; and adjusts, in response to detecting the curved section, the elongated body at least by the linking mechanism adjusting the angle between the two adjacent segments.

2. The drift robot of claim 1, further comprising a wireless communication interface configured to:

receive a user command from a remote-control console to the controller; and selectively send the sensor measurements and the camera images from the controller to the remote-control console.

3. The drift robot of claim 2, wherein the sensor measurements comprise an internal diameter of the well conduit and measured properties of particles found in the well conduit, and wherein the controller is further configured to selectively generate an alert based on the sensor measurements for sending to the remote-control console.

4. The drift robot of claim 1, wherein navigating the elongated body comprises:

retrieving the plurality of retractable landings while the elongated body traverses the well conduit; and extending the plurality of retractable landings against the internal surface of the well conduit when the elongated body reaches a target location in the well conduit.

5. The drift robot of claim 4, further comprising:

a global positioning system (GPS) device to determine a physical location of the elongated body, wherein said extending the plurality of retractable landings is in response to the physical location matching the target location.

6. A system for performing a drifting operation of a wellbore in a subterranean formation, comprising:

a remote-control console at the Earth surface that is used by a user to monitor the drifting operation; and a drift robot, comprising:

an elongated body to be deployed into a well conduit in the wellbore and comprising:

a plurality of segments connected into a sequence; and a linking mechanism that links two adjacent segments and adjusts an angle between the two adjacent segments;

a propulsion system for propelling the elongated body to traverse the well conduit;

a plurality of retractable landings attached to the elongated body for selectively anchoring the elongated body to an internal surface of the well conduit;

a plurality of sensors attached to the elongated body to generate sensor measurements of the well conduit;

a smart camera disposed at one end of the elongated body to capture camera images of interior features of the well conduit;

a controller that analyzes the camera images to detect a curved section of the well conduit; and adjusts, in response to detecting the curved section, the elongated body at least by the linking mechanism adjusting the angle between the two adjacent segments; and a wireless communication interface configured to:

receive a user command from the remote-control console to the controller; and selectively send the sensor measurements and the camera images from the controller to the remote-control console.

7. The system of claim 6, wherein the sensor measurements comprise an internal diameter of the well conduit and measured properties of particles found in the well conduit, and wherein the controller is further configured to selectively generate an alert based on the sensor measurements for sending to the remote-control console.

8. The system of claim 6, wherein navigating the elongated body comprises:

retrieving the plurality of retractable landings while the elongated body traverses the well conduit; and extending the plurality of retractable landings against the internal surface of the well conduit when the elongated body reaches a target location in the well conduit.

9. The system of claim 8, the drift robot further comprising:

a global positioning system (GPS) device to determine a physical location of the elongated body, wherein said extending the plurality of retractable landings is in response to the physical location matching the target location.

10. A method for performing a drifting operation of a wellbore in a subterranean formation, comprising:

disposing, from a wellhead of the wellbore, a drift robot into a well conduit in the wellbore, wherein the drift robot comprises:

an elongated body comprising:

a plurality of segments connected into a sequence; and a linking mechanism that links two adjacent segments and adjusts an angle between the two adjacent segments;

a propulsion system for propelling the elongated body to traverse the well conduit;

a plurality of retractable landings attached to the elongated body for selectively anchoring the elongated body to an internal surface of the well conduit;

a plurality of sensors attached to the elongated body to generate sensor measurements of the well conduit;

a smart camera disposed at one end of the elongated body to capture camera images of interior features of the well conduit;

a controller that analyzes the camera images to detect a curved section of the well conduit; and adjusts, in response to detecting the curved section, the elongated body at least by the linking mechanism adjusting the angle between the two adjacent segments; and a wireless communication interface to provide wireless data communications;

selectively sending, using the wireless communication interface, the sensor measurements and the camera images to a remote-control console at the Earth surface; and selectively displaying, using the remote-control console, the sensor measurements and the camera images for viewing by a user.

11. The method of claim 10, further comprising:

receiving a user command from the remote-control console to the controller.

12. The method of claim 11, wherein the sensor measurements comprise an internal diameter of the well conduit and measured properties of particles found in the well conduit, and wherein the controller is further configured to selectively generate an alert based on the sensor measurements for sending to the remote-control console.

13. The method of claim 10, wherein navigating the elongated body comprises:

retrieving the plurality of retractable landings while the elongated body traverses the well conduit; and extending the plurality of retractable landings against the internal surface of the well conduit when the elongated body reaches a target location in the well conduit.

14. The method of claim 13, the drift robot further comprising:

a global positioning system (GPS) device to determine a physical location of the elongated body, wherein said extending the plurality of retractable landings is in response to the physical location matching the target location.

* * * * *